US012522894B2

(12) United States Patent
Laptyeva et al.

(10) Patent No.: US 12,522,894 B2
(45) Date of Patent: Jan. 13, 2026

(54) ALUMINUM FOIL WITH IMPROVED BARRIER PROPERTY

(71) Applicants: Galyna Laptyeva, Alfter (DE); Michael Eberhard, Jüchen (DE); Jan Simmer, Düsseldorf (DE); Michael Wimmer, Cologne (DE); Günter Schubert, Rheinbach (DE); Dirk Calmer, Erkelenz (DE); Stefan Holz, Grevenbroich (DE)

(72) Inventors: Galyna Laptyeva, Alfter (DE); Michael Eberhard, Jüchen (DE); Jan Simmer, Düsseldorf (DE); Michael Wimmer, Cologne (DE); Günter Schubert, Rheinbach (DE); Dirk Calmer, Erkelenz (DE); Stefan Holz, Grevenbroich (DE)

(73) Assignee: Speira GmbH, Grevenbroich (DE)

( * ) Notice: Subject to any disclaimer, the term of this patent is extended or adjusted under 35 U.S.C. 154(b) by 0 days.

(21) Appl. No.: 18/333,992

(22) Filed: Jun. 13, 2023

(65) Prior Publication Data

US 2023/0323514 A1 Oct. 12, 2023
US 2025/0263816 A2 Aug. 21, 2025

Related U.S. Application Data

(63) Continuation of application No. PCT/EP2021/086404, filed on Dec. 17, 2021.

(30) Foreign Application Priority Data

Dec. 18, 2020 (EP) ..... 20215692

(51) Int. Cl.

| | |
|---|---|
| ***C22C 21/00*** | (2006.01) |
| ***B22D 11/00*** | (2006.01) |
| ***C22F 1/04*** | (2006.01) |

(52) U.S. Cl.
CPC ..... *C22C 21/00* (2013.01); *B22D 11/003* (2013.01); *C22F 1/04* (2013.01)

(58) Field of Classification Search
CPC ..... C22C 21/00
See application file for complete search history.

(56) References Cited

U.S. PATENT DOCUMENTS 4,483,719 A * 11/1984 Furrer ..... C22F 1/04 420/550
2002/0043310 A1 4/2002 Tavernier et al.
(Continued)

FOREIGN PATENT DOCUMENTS

CN 1478914 A 3/2004
CN 101798646 A 8/2010
(Continued)

OTHER PUBLICATIONS

Keles et al. (Journal of Materials Processing Technology 186 (2007) 125-137) (Year: 2007).*
(Continued)

*Primary Examiner* — Liam J Heincer
(74) *Attorney, Agent, or Firm* — Reinhart Boerner Van Deuren P.C.

(57) ABSTRACT

An aluminium alloy foil with a thickness of maximum 12 μm, maximum 9 μm or less than 8 μm. The aluminium alloy foil is an AA1xxx or A8xxx aluminium alloy in the annealed state. In addition, a method for manufacturing an aluminium alloy foil and its use. The object of proposing an aluminium alloy foil with improved barrier properties, a method for its manufacture and a use of the aluminium alloy foil is achieved in that the aluminium alloy foil has a maximum number of pores with a pore size of 1 μm to 200 μm of maximum 12 per $dm^2$, maximum 8 per $dm^2$ or maximum 6
(Continued)

per $dm^2$. In addition, a method is specified for how this aluminium alloy foil can be manufactured.

15 Claims, 3 Drawing Sheets

(56) References Cited

U.S. PATENT DOCUMENTS

| | | | | |
|---|---|---|---|---|
| 2007/0237978 | A1* | 10/2007 | Schubert | B21B 1/40 427/178 |
| 2020/0123639 | A1* | 4/2020 | Suzuki | C22C 21/00 |
| 2020/0216933 | A1* | 7/2020 | Suzuki | C21D 8/0236 |
| 2020/0266449 | A1* | 8/2020 | Laptyeva | H01M 4/663 |
| 2020/0365906 | A1* | 11/2020 | Tanaka | C22F 1/04 |
| 2023/0357899 | A1* | 11/2023 | Mishra | C22C 21/00 |

FOREIGN PATENT DOCUMENTS

| | | | |
|---|---|---|---|
| CN | 102329988 | A | 1/2012 |
| CN | 102329989 | A | 1/2012 |
| CN | 102329990 | A | 1/2012 |
| CN | 102329991 | A | 1/2012 |
| CN | 102409199 | A | 4/2012 |
| CN | 106011708 | A | 10/2016 |
| CN | 107312953 | A | 11/2017 |
| CN | 107475569 | A | 12/2017 |
| CN | 108160738 | A | 6/2018 |
| CN | 110157957 | A | 8/2019 |
| EP | 0750685 | A1 | 1/1997 |
| EP | 2067871 | A1 | 6/2009 |
| WO | WO 03/069003 | A2 | 8/2003 |

OTHER PUBLICATIONS

Delijic et al. (The Mechanical Properties and Corrosion Behavior of an Al—Fe—Si (AA8079) Twin Roll Cast Foil, 2nd International Conference on: Deformation Processing and Structure of Materials, 2005, p. 107-112) (Year: 2005).*

Anderson et al. (1xxx Aluminum Alloy Datasheets, ASM Handbook, vol. 2B, Properties and Selection of Aluminum Alloys, 2019). (Year: 2019).*

Ucar et al. (Light Metals, 2017, p. 273-278) (Year: 2017).*

Modern Aluminium Alloy Sheet and Strip, Hongzhang Zhou, Metallurgical Industry Press, p. 343, published Apr. 30, 2012.

Aluminium Alloy Material and Heat Treatment Technology Thereof, Niankui Li et al., Metallurgical Industry Press, pp. 310-311, published Apr. 30, 2012.

* cited by examiner

10 µm Mag = 500X EHT = 10.000 kV Signal A = SE2
File Name =013.tif WD = 8,4mm

1 µm Mag = 500KX EHT = 200 kV Signal A = SE2

ALUMINUM FOIL WITH IMPROVED BARRIER PROPERTY

CROSS-REFERENCE TO RELATED PATENT APPLICATIONS

This patent application is a continuation of International Application No. PCT/EP2021/086404, filed on Dec. 17, 2021, and which claims the benefit of priority to European Patent Application No. 20215692.3, filed Dec. 18, 2020, the entire teachings and disclosures of the aforementioned applications are incorporated herein by reference thereto.

FIELD OF THE DISCLOSURE

The invention relates to an aluminium alloy foil with a thickness of maximum 12 μm, maximum 9 μm or less than 8 μm, wherein the aluminium alloy foil has an AA1xxx, or A8xxx aluminium alloy in the material state H2x or O. In addition, the invention relates to a method for manufacturing an aluminium alloy foil and its use.

BACKGROUND OF THE INVENTION

Aluminium alloy foils of the aforementioned thicknesses are often used in food packaging, wherein, for example, they are part of multi-layer composite materials. The aluminium alloy foils contained in multi-layer composite materials are mainly used due to their good barrier properties. Usually, the aluminium alloy foil has a very good barrier effect e.g. for water vapour, oxygen, carbon dioxide and larger molecules such as flavourings. This is achieved by the crystalline structure of the aluminium alloy foil, which substantially prevents the solubility and diffusion of larger atoms through the crystal bond. Material can only be transported through the aluminium alloy foil on defects in an aluminium alloy foil, for example on pores or holes. Pores are tiny breakthroughs in aluminium alloy foils that can be detected by a local passage of light through the foil. In accordance with DIN EN 546-4, pores in an aluminium alloy foil are randomly distributed holes with a diameter of maximum 200 μm. From 200 μm, according to a definition in DIN EN 546-4, these are rolling holes. It was previously known that the porosity of aluminium alloy foils increases with decreasing thickness. Thereby, pores can have a number of different causes. Inclusions or impurities in the molten metal, for example those from refractory materials or rough casting phases (e.g. $Al_3Fe$), can fall out of the rolled material during rolling and leave rolling holes in the aluminium alloy foil. If the particles trapped in the metal are particularly brittle, such as $Al_3Fe$ phases, these can also break during rolling and the smallest fragments can be rolled into the rolled material. This results in individual pores or pore lines in the rolled aluminium alloy foils, which impair the barrier properties of the aluminium alloy foil. In addition, investigations into the present invention have discovered that aluminium alloy foils can also have micropores with a size of significantly less than 20 μm, in particular with a size of 1 μm to 5 μm, which can occur in very large numbers, locally limited in so-called "populations", which typically extend in the rolling direction of the aluminium alloy foil. The pores referred to as micropores can also have a negative effect on the barrier properties of the aluminium alloy foil.

A necessary process in the manufacture of aluminium alloy foils for the manufacture of multi-layer composite materials is the final annealing for degreasing the rolled aluminium alloy foil. Rolling oil emulsions and rolling oils are used when rolling aluminium alloy strips and foils. Their residues must be removed from the foil after rolling so that properties of the aluminium alloy foil which are important for processing into multi-layered materials, such as adhesion properties, wetting properties have a predetermined level. For this purpose, the foils are wound into a coil or into an assembled roll and annealed as a coil or roll. The rolling media present on the aluminium alloy foil must be removed substantially as completely as possible from the coil or from the roll by decomposition and evaporation. The temperature treatment brings the aluminium alloy foil either into the partially hard material state H2x or into the soft annealed material state O.

From the US patent application US 2002/0043310 A1 it is known that an AlFe aluminium alloy foil with a thickness of less than 12 μm is degreased by a final annealing at temperatures of 200° C. to 300° C. for at least 50 hours. In material state O with a thickness of less than 12 μm, the aluminium alloy foil has a porosity of less than 10 pores/$dm^2$ in accordance with DIN EN 546-4. In the exemplary embodiment from the aforementioned US patent application, the foils with a thickness of 6.6 μm are soft annealed for 80 hours at 280° C. Although the known aluminium alloy foils have a porosity according to DIN EN 546-4 of 6 pores/$dm^2$, the barrier properties of the aluminium alloy foil cannot be secured by this.

DIN EN 546-4 only covers pores with a minimum size of 20 μm. Pores with a size smaller than 20 μm are not covered by DIN EN 546-4. In practice, most pores have a round or oval shape with irregular edges. To determine the pore size, the area of the pore is determined in transmitted light under a microscope under imaging of the exact contour with edges that are as sharp as possible, and from this an area-equivalent circle diameter is calculated. To measure the porosity in accordance with DIN EN 546-4, the rolled foils are tested using a light box. Thereby, the foil sample is placed on the light box; in the case of a double-rolled foil, the matt side faces the tester. The test is carried out in accordance with DIN EN 546-4 in a darkened room with a remaining maximum luminance of 20 to 50 lux. A translucent glass plate is used as a light box, said glass plate being illuminated from below with the help of a light source that delivers a uniform luminance of 1000 to 1500 lux. According to a variant in DIN EN 546-4, the porosity can be measured such that a measuring surface of 1 $dm^2$, which has the highest porosity and thus represents the worst measuring surface on the foil, is selected from a larger foil surface. The number of pores determined on this measuring surface in accordance with DIN EN 546-4 was determined as a measure of porosity. However, even if the worst measuring surface of the foil according to DIN EN 546-4 has a very low porosity, the barrier properties of the foil could not always be ensured, as the occurrence of the detected micropores with a size of less than 20 μm, or with sizes from 1 μm to 5 μm, is not covered by DIN EN 546-4.

SUMMARY OF THE INVENTION

Proceeding from this prior art, the object underlying the present invention is therefore to propose an aluminium alloy foil with improved barrier properties, a method for its manufacture and a use of the aluminium alloy foil according to the invention.

The aforementioned object is achieved according to a first teaching of the present invention in that the aluminium alloy foil has a maximum number of pores with a pore size of 1 μm to 200 μm of maximum 12 per $dm^2$, maximum 8 per $dm^2$ or maximum 6 per $dm^2$.

It has been found that the pores not covered by DIN EN 546-4, namely pores with a pore size of less than 20 μm, can significantly influence the barrier properties of an aluminium alloy foil. By taking into account even the smallest pores from 1 μm when limiting the maximum number of pores with a pore size of 1 μm to 200 μm to a maximum of 12 per $dm^2$ or a maximum of 8 per $dm^2$ or a maximum of 6 per $dm^2$, aluminium alloy foils according to the invention can be provided which have significantly better barrier properties compared to the aluminium alloy foils manufactured according to DIN EN 546-4. This is due to the fact that in the aluminium alloy foils according to the invention, the influence of so-called micropores with a size of 1 μm to 20 μm on the barrier properties is also minimised. The aluminium alloy foils according to the invention are therefore particularly suitable for being used as a barrier layer, for example in a multi-layer composite material.

Pores with a size of 1 μm to 20 μm, in particular 1 μm to 5 μm, can be found in conventional aluminium alloy foils in so-called "populations", which are spatially limited and which extend in the rolling direction. Nonetheless, these populations still contain a large number of micropores.

According to the present invention, the maximum number of pores per $dm^2$ with a pore size of 1 μm to 200 μm is determined by dividing the aluminium alloy foil over the entire foil width into measuring surfaces with a size of 5 to 6 $dm^2$ and an edge length of 100 mm to 320 mm transverse to the rolling direction of the aluminium alloy foil such that at least 3, preferably at least 5 measuring surfaces result over the entire width of the aluminium alloy foil. The number of pores with a pore size of 1 μm to 200 μm is then determined in each measuring surface. From the measuring surface with the highest number of pores per measuring surface, the maximum number of pores per $dm^2$ is determined by dividing by the selected size of the measuring surface and rounded to an integer number of pores. The maximum number of pores is measured after final annealing in the material state H2x or O, for example on coils or assembled rolls. In this context, assembled means that the aluminium alloy foil has already been cut at least in width for later use.

The parameter of the maximum number of pores per $dm^2$ according to the present invention also covers micropores which, with a size of 1 μm to 20 μm, can occur locally clustered in so-called populations. As already mentioned, these populations often extend in the rolling direction of the aluminium alloy foil and can be found locally limited only in certain regions of the aluminium alloy foil. However, when determining the maximum number of pores per $dm^2$ according to the present invention, these populations of micropores are reliably detected since the entire width of the foil is taken into account. The aluminium alloy foil according to the invention with a maximum number of pores of maximum 12, maximum 8 or preferably maximum 6 per $dm^2$ is therefore almost free of micropores and thus provides particularly good barrier properties.

The number of pores is measured in a completely darkened room with a residual luminance of less than 0.25 lux. Thereby, the surface of the aluminium alloy foil to be measured is placed on a transparent glass surface and fixed with a frame, the inner dimensions of which correspond to the measuring surface. A light source with an illumination of the measuring surface as uniform as possible is arranged below the glass plate. The foil is fixed via the frame such that the measuring surface on the aluminium alloy foil is defined and substantially no residual light from the light source is emitted past the foil. The edges of the foil must be completely darkened. For example, a flat light source with at least 15,000 lux luminance can be used as a light source with glass plate.

In the darkened room, the measuring surface is photographed with a digital camera centred over the measuring surface, whereby an exposure time of 30 s with an ISO value of 800 or more should be used in order to be able to detect light penetration also through the smallest pores with a size of 1 μm to 20 μm. The distance of the camera must be selected such that the measuring surface is completely covered. However, the distance should be selected as small as possible. The number of pores with a size of 1 μm to 200 μm of the photographed measuring surface of the aluminium alloy foil is then to be evaluated digitally via image analysis software.

As already described, this examination method can also be used to measure micropores with a pore size of 1 μm or more. It has been shown in the outcome that especially pores with a pore size of less than 20 inn, in particular less than 5 μm, can significantly impair the barrier properties of the aluminium alloy foil. The cause of this is seen in the locally limited, population-like occurrence of micropores with high pore density. Accordingly, a plurality of micropores, which significantly reduce the barrier properties of the aluminium alloy foil locally, can be present in narrowly limited regions of the aluminium alloy foil. However, the aluminium alloy foils according to the invention with a maximum number of pores per $dm^2$ of maximum 12, maximum 8 or maximum 6 pores with a pore size of 1 μm to 200 μm have particularly good barrier properties, since they do not have any areas with a high micropore density.

It has been found that in order to provide the aluminium alloy foil according to the invention, precautions must be taken in the entire manufacturing chain of the aluminium alloy foil in order to keep the number of pores with a pore size of 1 μm to 200 μm low. Thus, already during the manufacture of the aluminium alloy for the aluminium alloy foil, the melt can be filtered before and/or during the casting of the rolling ingot and corresponding filters can be passed through in order to keep non-metallic inclusions out of the alloy. Ideally, cleaning of the melt should already start in the furnace. As a result, some of the impurities are removed at an early stage before casting and costs are saved. In the furnace, the melt can be cleaned by gas flushing with Ar, N2, by salt treatments and leaving to settle. These measures are often combined for effective melt cleaning. This usually removes carbides, oxides and alkaline metals. The impurities are transported to the melt surface with the help of gas bubbles and absorbed by the dross. After a settling time, the accumulated impurities are scraped off. During casting, in-line cleaning processes, such as degassers and filters, can be used on the way from the furnace to the chill moulds. The degassers work with a purge gas, for example the purge gases Ar, N2 mentioned above. On the one hand, they serve to reduce the hydrogen content in the melt. On the other hand, there are also filter/flotation effects due to the purge gases, which can remove particle-like inclusions or, for example, oxide skins. The purge gases are usually introduced via rotors in order to generate fine gas bubbles and thus further improve the degassing and filtering effect. The degassers can be equipped with more than one treatment chamber so that a series of a plurality of degassers can be used in one unit. At the outlet of these degassers with a plurality of treatment chambers, a chamber can be provided for leaving the melt to settle, in which remaining bubbles and inclusions can migrate to the strip surface and thus be discharged from the melt.

For further cleaning of the melt, filters can be applied which use different filter mechanisms. Foam ceramic filters such as CFF foam ceramic plate filters and deep bed filters are used as filters. For example, a casting system with a furnace for 70 t can be equipped, between furnace and casting system, with an in-line degasser of type SIR filter and a degasser from the company HYCAST for a throughput of 50 t/h as well as a downstream CFF foam ceramic plate filter with a pore size finer than 40 ppi ("pores per inch"). The CFF foam ceramic filter plate is thereby used as a disposable filter, for example, and is replaced after each casting. Alternatively, a deep bed filter, also known as a bulk bed filter, can be used. Thereby, the filter medium consists of alternating layers of balls and broken balls made of tabular alumina with a diameter of up to approx. 20 mm, for example, which are layered in a filter box of approx. 2×3 m.

In the case of DC casting, homogenisation of the cast rolling ingot at the temperatures and durations provided for the specific alloy types additionally leads to a reduction of coarse casting phases in the rolling ingot, for example coarse Al3Fe casting phases and thus to the avoidance of correspondingly brittle particles in the very thinly rolled aluminium alloy foils.

In the continuous strip casting process (CC casting), for example using a twin-roll caster (TRC), the molten metal is, for example, fed to water-cooled rollers, where it solidifies. The solidified strip is then immediately further rolled. The melt goes through the same cleaning steps in the furnace as in the case of DC casting. This removes foreign phases such as carbides and oxides. In contrast to DC casting, the strips manufactured in CC casting tend to form so-called centre segregations, which are present either in the form of coarse intermetallic phases, e.g. AlFe phases in the case of AlFeSi alloys or in the form of enrichments of other alloy elements. The composition of the precipitates depends on the respective composition of the alloy and the selected parameters of the casting process. The composition of the AlFeSi alloy influences, for example, the width of the interval of the temperature at which the melt solidifies, which is also called the solidification interval. The wider the solidification interval, the greater the tendency to form centre segregations. In order to counteract the formation of segregations, the casting speed is reduced, for example, while simultaneously increasing the cooling power. The casting speed in the TRC process, for example, varies between 1000 and 2500 mm/min. The cooling output is influenced by the outside diameter of the rollers. The larger the outside diameter, the higher the cooling power. For example, for an AA8xxx alloy with a solidification interval of 30 K, a casting speed of 1000 to a maximum of 1500 mm/min can be selected for a roller diameter of approx. 600 mm. For purer aluminium alloys, such as for example type AA1050 or AA1070, in contrast, a higher casting speed of 2000 to 2500 mm/min at a roller diameter of approx. 900 mm is advantageous in order to counteract centre segregations.

After foil rolling, degreasing takes place by way of an annealing process to provide the material state H2x and O. It was recognised here that the degreasing process by annealing the rolled aluminium alloy foil can exert a large influence on the presence of pores with a pore size of 1 μm to 20 μm. Surprisingly, it was possible to significantly reduce the formation of micropores by reducing the annealing temperature to a maximum of 245° C. while simultaneously extending the annealing duration and taking into account a special cooling phase of a maximum of 3 h at 100° C.

According to a further configuration of the invention, the aluminium alloy foil according to the invention is characterised in that the aluminium alloy foil has an oxide layer thickness of 3 to 6 nm measured along the entire width of the aluminium alloy foil, wherein the oxide layer thickness of the aluminium alloy foil at the edge region of the aluminium alloy foil is at most 30% greater than in the middle of the aluminium alloy foil. Not only is the oxide layer thickness particularly thin with 3 to 6 nm, it is homogeneous over the width of the aluminium alloy foil and shows only a slight increase towards the edge regions. The cause of this advantageous property of the aluminium alloy foil according to the invention is seen in the specific degreasing annealing with subsequent cooling process. This results in more uniform surface properties for use in a multi-layer composite material. For example, the uniform oxide layer thickness distribution keeps the adhesive properties of the foil particularly constant over the entire width. The layer thickness of the aluminium oxide layer can be measured, for example, by ATR (attenuated total reflection) infrared spectroscopy. With this measuring method, the oxide layer thickness can be detected over the complete thickness with a resolution in the subnanometer range.

According to a further configuration of the aluminium alloy foil, the oxide layer thickness is maximally 5 nm both on the matt and gloss side of the aluminium alloy foil. The reduced thickness of the oxide layer due to the manufacturing process leads to better adhesive properties of the surface of the aluminium alloy foil and thus to a good suitability of the aluminium alloy foil for a multi-layer composite material, for example for packaging means, for example as part of a flat bag packaging.

If according to a next configuration the aluminium alloy foil has an aluminium alloy with the following alloy constituents in % by weight:

$0.05\% \leq Si \leq 0.30\%$,
$0.7 \leq Fe \leq 1.3\%$,
$Cu \leq 0.05\%$,
$Mn \leq 0.05\%$,
$Mg \leq 0.05\%$,
$Cr \leq 0.05\%$,
$Zn \leq 0.10\%$,
$Ti \leq 0.025\%$, the remainder Al and unavoidable impurities individually 0.05% by weight, in total at most 0.15% by weight, a higher-strength and at the same time cost-effective aluminium alloy foil can be provided.

Despite the low contents of the alloy constituents, the properties in AlFeSi alloys are decisively influenced by the elements in solution as well as by the binary AlFe and ternary AlFeSi phases. When the casting solidifies, an Al mixed crystal supersaturated with Si and Fe forms. Due to the low solubility, Fe is precipitated as an intermetallic compound Al3Fe and is deposited at the grain boundaries of the Al mixed crystal. This binary phase is stable and hardly changes during subsequent thermomechanical treatment. Only in the rolling process, AlFe phases are crushed under the effect of the rolling forces. The equilibrium solubility of Fe in aluminium is low and is max. 400 ppm (655° C.). The maximum solubility of Si is significantly higher and is 1.65% (577° C.). Strength and elongation are positively influenced by an addition of Si. Silicon forms AlFeSi dispersoids and thus contributes to an increase in strength due to particle hardening as well as to an increase in elongation. The Si atoms which are present in solution in the Al matrix contribute to mixed crystal hardening. The silicon-containing AlFeSi precipitates also represent nucleation centres for recrystallisation and therefore improve the recrystallisation properties of the aluminium alloy foil. However, as the Si content increases, the solubility of iron and thus also the strength contribution of Fe through mixed crystal hardening decreases, such that the Si content is preferably limited to a maximum of 0.30% by weight. To prevent strength from deteriorating, the Si content is preferably at least 0.05% by weight.

Iron in solution also leads to an increase in strength, at the same time with a fine grain size and an increase in the thermal stability of the aluminium alloy foil, such that preferably at least 0.7% by weight iron is contained. Fe contents of less than 0.7% by weight reduce the proportion of iron in solution and a low phase density occurs such that the strength of the aluminium alloy foil is reduced. However, iron has a rather low solubility in the aluminium matrix and forms AlFe intermetallic phases when solidifying from the casting. These precipitates are coarse and rather detrimental to the mechanical properties. Therefore, the iron content is limited to 1.3% by weight.

Due to the high solubility of Cu, Mn, Mg or Cr in the aluminium matrix, these elements remain largely in solution at the specified upper limits of maximally 0.05% by weight and contribute to the strength of the aluminium alloy foil. Excessive weight proportions of Cu, Mn, Mg or Cr can be used to further increase strength. However, they also lead to an undesired increase in the necessary rolling force in the foil rolling process. Zinc also increases the strength, but also has positive effects on the refinement of the grain structure such that preferably a maximum of 0.10% by weight is permitted.

Titanium acts as a grain refiner and leads to a slight increase in strength and recrystallisation temperature. The aluminium alloy foil contains a maximum of 0.025% by weight of titanium in order to set good casting properties with a fine grain structure but at the same time good recrystallisability of the aluminium alloy foil.

According to a preferred variant, the aluminium alloy of the aluminium alloy foil has at least one of the following restrictions of the alloy constituents in % by weight:

0.8%≤Fe≤1.15%,

Cu≤0.05%, 0.01%≤Mn≤0.04%, preferably 0.015%≤Mn≤0.035%, particularly preferably 0.018%≤Mn≤0.025%, Mg≤0.01%, preferably Mg≤0.005%, particularly preferably Mg≤0.0035%, Cr≤0.02%, Zn≤0.07% and/or 0.005%≤Ti≤0.025%.

As explained in the above section, the weight proportions of Si and Fe are selected such that an optimal Fe solution condition at an optimal AlFe, AlFeSi phase density and thus the optimal strength parameters can be set in the manufacturing process adapted to the foil product requirements. From a preferred Fe content of 0.8% by weight, the strength and thermal stability of the aluminium alloy foil increase again. The coarsening of the grain structure is also counteracted. Exceeding 1.15% by weight Fe leads to a higher density of intermetallic AlFe casting phases and thus to a reduction in elongation and deterioration of porosity.

The manganese content of the aluminium alloy in % by weight is preferably 0.01%≤Mn≤0.04%, preferably 0.015%≤Mn≤0.035%, particularly preferably 0.018%≤Mn≤0.025%. At an Mn content below 0.01% by weight, the strength and thermal stability of the aluminium alloy foil are reduced. At contents of more than 400 ppm manganese, conversely, the rolling force during foil rolling and thus also the process costs increase. A good compromise between increased strength and process costs is therefore achieved at contents of 0.0150% by weight to 0.035% by weight, preferably at 0.018% by weight to 0.025% by weight.

The element Mg is characterised by very good diffusion in the Al matrix and therefore tends to enrich the foil surface. Therefore, the Mg content is limited to a maximum of 0.01% by weight, preferably a maximum of 0.005% by weight, particularly preferably to a maximum of 0.0035% by weight. Adherence to these values ensures that undesired formation of magnesium oxide or magnesium hydroxide products due to Mg enrichments on the foil surface does not occur when exposed to temperature in the customer process, which has adverse effects on the adhesion of coatings.

The Zn content is preferably limited to a maximum of 0.07% by weight in order to reduce the rolling forces during foil rolling.

Cr and Ti are only present in the aluminium alloy in low contents. The Cr content is limited to a maximum of 0.02% by weight. Cr is easily soluble in the aluminium matrix and leads to a significant increase in rolling force during foil rolling even at low contents. Ti is limited to a maximum weight proportion of 250 ppm, whereby consideration of a minimum content of at least 50 ppm Ti leads to better castability with simultaneously good mechanical properties. This ensures, on the one hand, that the additional costs due to the unnecessarily high addition of alloy elements are avoided and, on the other hand, that the foil flow stress and thus also the rolling forces do not exceed the limits provided for in the foil rolling process.

According to a further configuration of the aluminium alloy foil according to the invention, the aluminium alloy foil in the material state O has a yield strength Rp0.2 of at least 55 MPa, preferably at least 58 MPa, measured transversely, longitudinally or diagonally to the rolling direction. In conjunction with the reduced maximum number of pores per $dm^2$, the aluminium alloy foil according to the invention is very good for being processed into multi-layer composite materials.

In relation to the C coating of the aluminium alloy foil, i.e. the carbon quantity from the rolling media, which remain on the aluminium alloy foil after finish-annealing, the aluminium alloy foil according to the invention also has an improvement. According to a further configuration of the aluminium alloy foil, the C coating in the middle of the aluminium alloy foil is 20% lower than in the edge regions of the aluminium alloy foil. Typically, the differences across the strip width between the edge and middle regions of the aluminium alloy foil are significantly greater. Also due to the more homogeneous C coating over the foil width, the aluminium alloy foil according to the invention has more uniform properties, for example adhesive properties.

To determine the C coating of the aluminium alloy foil, 5 cm wide foil strips in the gram range are cut in the longitudinal direction from the annealed foil coil or from the annealed foil roll, wound up, weighed precisely and burned at 600° C. in a quartz tube in an oxygen flow. The CO2 thereby resulting from rolling oil and its residues is measured quantitatively by coulometry or IR spectroscopy. The area of the sample is calculated from the weight of the sample, the density and the foil thickness. The C coating is specified in $mg/m^2$ foil. The samples are taken at least in the middle and at the edges of the annealed aluminium alloy foil. For example, a total of 5, 7, 9 or more strips can be extracted symmetrically to the middle of the annealed aluminium alloy foil, taking into account the edges, in order to determine the distribution of the C coating over the width of the aluminium alloy foil.

According to a further configuration of the aluminium alloy foil according to the invention, the aluminium alloy foil has a tensile strength of at least 80 MPa in the factory state H2x or O, measured transversely, longitudinally and/or diagonally to the rolling direction. To achieve a low maximum number of pores, the aluminium alloy foil with the aforementioned composition is subjected to the specified manufacturing steps, which cause an increase in the tensile strength Rm to more than 80 MPa already in the material state H2x, but in particular in the material state O. The higher tensile strength allows, for example, an increase in lane tension during processing of the aluminium alloy foil and thus a faster processing of the aluminium alloy foil, for example in the manufacture of a multi-layer composite material.

This also applies to the next configuration of the aluminium alloy foil according to the invention, according to which the elongation at break $A_{100mm}$ of the aluminium alloy foil is at least 6.2%, preferably at least 6.5%, measured diagonally to the rolling direction. Surprisingly, the elongation at break value diagonally to the rolling direction remains almost constant, despite the increase in tensile strength values and yield strength values, and drops only very slightly compared to a standard foil. Improved elongation at break values $A_{100mm}$ are also advantageous for the processing of the aluminium alloy foil, in particular in the manufacture of aluminium composite materials with multi-layer systems and the manufacture of packages, in particular during recessing, bending, folding and sealing, since the risk of a tearing of the aluminium alloy foil during processing is thereby reduced.

According to a second teaching of the present invention, the above-mentioned object is achieved by a method for manufacturing an aluminium alloy foil in that the method comprises the following steps:

- manufacturing an aluminium alloy strip for cold rolling by casting a rolling ingot from an aluminium alloy of an AA1xxx or AA8xxx aluminium alloy, wherein the aluminium alloy melt is filtered before and/or during the casting of the rolling ingot, homogenising the cast rolling ingot and hot rolling of the rolling ingot into a hot strip or continuous casting of a casting strip from a melt of a filtered aluminium alloy of type AA8xxx or AA1xxx with a subsequent, optional hot rolling of the casting strip,
- cold rolling of the aluminium alloy strip to a first intermediate thickness,
- recrystallisation annealing of the cold-rolled aluminium alloy strip at this intermediate thickness,
- cold rolling of the aluminium alloy strip to a second intermediate thickness,
- doubling the aluminium alloy strip and carrying out an intermediate annealing,
- foil rolling of the doubled aluminium alloy strip to the final thickness of the doubled foil,
- separating and winding up the layers at a final thickness of the individual layers of maximum 12, maximum 9 μm or less than 8 μm, wherein optionally the aluminium alloy foil is assembled in a plurality of rolls and
- carrying out a final annealing of the coil or the assembled rolls for at least 150 h at 200 to 245° C., preferably at most 240° C. or at most 235° C. furnace air temperature with a final cooling phase for at least 3 h at 100° C. furnace air temperature.

It has been found that particularly advantageous properties of the aluminium alloy foil in the material state H2x or O can be achieved by the combination of the above-mentioned process characteristics, starting with the casting of a rolling ingot or the casting of a casting strip from a filtered aluminium alloy of an AA1xxx or A8xxx aluminium alloy until the carrying out of the degreasing annealing in the form of a final annealing for at least 150 hours at 200 to 245° C. furnace air temperature with a final cooling phase for at least 7 hours at 100° C. furnace air temperature. In addition to advantageous properties in relation to the oxide layer thickness of the aluminium alloy foil and its C coating with carbon, it was possible, above all, to significantly reduce the maximum number of pores per $dm^2$ with a pore size of 1 μm to 200 μm of the aluminium alloy foil and thus to stabilise the barrier properties of the manufactured aluminium alloy foil in a process-reliable manner. It has been found that when the claimed temperature window is adhered during the annealing process and the cooling phase, significantly fewer or no micropores with a size of less than 5 μm can be found in the aluminium alloy foil. Lower temperatures of, for example, a maximum of 240° C. or a maximum of 235° C. showed an even lower maximum number of pores per $dm^2$. The cooling phase of at least 3 h, preferably 7 h at 100° C. causes "smooth" cooling of the roll already in the furnace such that all layers in the foil roll reach the temperature of approx. 100° C. The long holding time of at least 3 h, preferably at least 7 h has the effect that the temperature gradient within the roll is as small as possible before the roll leaves the furnace. This prevents warping of the foil layers during the final cooling in the air. In addition, the foil surface is chemically activated after completion of the annealing at 200° C. to maximally 245° C. The controlled cooling to 100° C. prevents strong oxidation of the foil surface with moist air and thus prevents the formation of undesired oxidation products on the foil surface, which can lead to the adhesion of layers of the foil roll, for example. As a result, improved unwinding properties of the aluminium alloy foil can thereby be guaranteed.

For strip casting, the casting speed is to be adapted to the solidification interval. The casting speed, for example when using a twin-roll casting process, varies between 1000 and 2500 ram/min. The cooling power is influenced by the outside diameter of the rollers, whereby a larger outside diameter can provide a higher cooling power. For example, for an AA8xxx alloy with a solidification interval of 30 K, a casting speed of 1000 to a maximum of 1.500 mm/min can be selected for a roller diameter of approx. 600 mm. For purer AA1050 or AA1070 alloys, in contrast, a higher casting speed of 2000 to 2500 mm/min is selected for a roller diameter of 900 mm, for example. The formation of centre segregations can thus be avoided. At the same time, this also significantly reduces the formation of pores in the aluminium alloy foil.

If according to a further configuration of the method according to the invention, the aluminium alloy has the following alloy constituents in % by weight:

0.05%≤Si≤0.30%,
0.7%≤Fe≤1.3%,
Cu≤0.05%,
Mn≤0.05%,
Mg≤0.05%,
Cr≤0.05%,
Zn: ≤0.10%,
Ti: ≤0.025%, the remainder Al and unavoidable impurities individually 0.05% by weight, in total at most 0.15% by weight, and the recrystallisation annealing of the cold-rolled strip is carried out at furnace air temperature of 450° C. to 550° C. for at least 5 h and the intermediate annealing after doubling the strip is carried out at a furnace air temperature of 240° C. to 320° C. for 0.5 h, an aluminium alloy foil with a thickness of, for example, 6.3 μm with yield strength values Rp0.2 measured transversely, longitudinally or diagonally to the rolling direction of at least 55 MPa, preferably at least 58 MPa in the material state O can be manufactured. The increased yield strength values improve the handling of the soft-annealed aluminium alloy foil during further processing of the aluminium alloy foil, for example into a multi-layer composite material. Regarding the effects of the individual alloy constituents, reference is made to the explanations on the aluminium alloy foil.

According to a further configuration of the method, the aluminium alloy has at least one of the following restrictions of the alloy constituents in % by weight:

0.8%≤Fe≤1.15%,

Cu≤0.05%, 0.01%≤Mn≤0.04%, preferably 0.015%≤Mn≤0.035%, particularly preferably 0.018%≤Mn≤0.025%, Mg≤0.01%, preferably Mg≤0.005%, particularly preferably Mg≤0.0035%, Cr≤0.02%, Zn≤0.07% and/or 0.005%≤Ti≤0.025%.

Regarding the technical effects of the preferred restrictions of the aluminium alloy constituents, reference is made to the explanations on the aluminium alloy foil according to the invention. In the method for manufacturing the aluminium alloy foil, the focus is not only on the mechanical properties, but also on the rolling forces and the lowest possible maximum number of pores per $dm^2$.

All specified mechanical parameters such as tensile strength $R_m$, yield strength $R_{p0.2}$ or elongation at break $A_{100mm}$ are measured in accordance with DIN EN 546-2. The elongation at break values are exclusively $A_{100mm}$ values.

In addition to casting a filtered aluminium alloy foil alloy, according to a further configuration it is advantageous to carry out the homogenising of the rolling ingot at 420° C. to 600° C. for at least 7 hours. During homogenisation, the already cold cast ingot is brought to a temperature close to the melting point in order to reduce or eliminate micro segregations that occurred during the solidification of the ingot. During homogenisation, unstable phases are also dissolved and converted into stable phases. After preheating before homogenisation, fine phases in the form of dispersoids are separated out when the ingot cools down again. Homogenising thus leads to the setting of a homogeneous structure with the lowest possible proportion of micro segregation and a precipitation structure favourable for the rollability and the final product properties.

It has also been found that it is advantageous for the rolling ingot to be hot rolled according to a further configuration to a hot rolling final thickness of 2 mm to 4 mm during hot rolling and for the hot rolling final temperature to be between 300° C. and 350° C. after the hot rolling strip has been wound. Thereby, it is achieved that the hot strip recrystallises statically after winding and thus that maximum degrees of rolling reduction in the first cold rolling are enabled. This in turn has a positive influence on recrystallisation during the first intermediate annealing, since the recrystallisation energy is reduced due to the high solidification by cold rolling with high degrees of rolling reduction.

By carrying out the final annealing for at least 150 hours at a temperature of 200° C. to 225° C. according to a further configuration of the method, additional positive properties can be achieved. In particular, the occurrence of micropores in the order of less than 20 μm, in particular of micropores with a size of 1 μm to 5 μm, is limited even more strongly by reducing the upper limit temperature to 225° C. and thus the barrier properties of the aluminium alloy foil for use in multi-layer composite materials, for example in the field of composite packaging, are ensured by the production process.

Finally, the use of the aluminium alloy foil according to the invention or of the aluminium alloy foil produced using the method according to the invention in multi-layer composite materials, which are used in particular in the field of packaging, is particularly advantageous. Corresponding aluminium alloy foils can also be advantageously used in packages to be folded, bent, grooved, deep-drawn or stretch-drawn, since here the very good barrier properties of the aluminium alloy foil ensure better protection for the products packaged with them.

Cardboard packaging, in particular sterilisable cardboard packaging having a multi-layer composite material with an aluminium layer benefit from the very good barrier properties of the aluminium alloy foil according to the invention.

BRIEF DESCRIPTION OF THE DRAWINGS

The invention is described in greater detail below using exemplary embodiments in connection with the drawing, in which is shown.

DETAILED DESCRIPTION

Figure 1A:
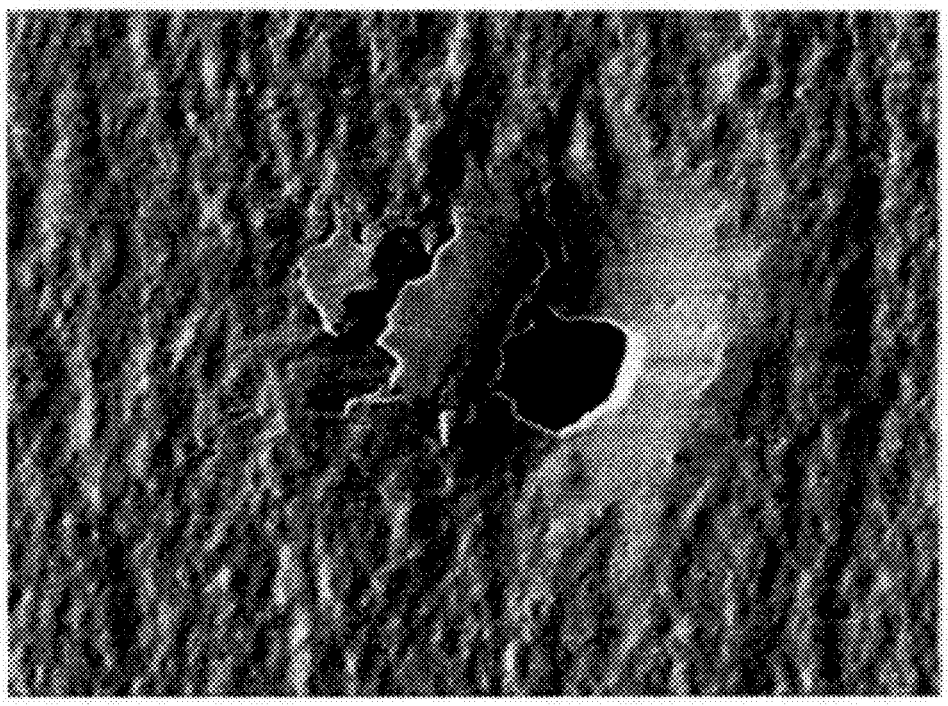
FIG. 1*a* a SEM image of a roll pore of a foil, which is recorded with DIN EN 546-4, FIG. 1*b* a SEM image of a section of a package of aluminium alloy foils charged with micropores, FIG. 2 a schematic sectional view of a device for measuring the maximum number of pores per 1 $dm^2$ across the foil width, FIG. 3 a schematic plan view of the measuring surfaces for determining the maximum number of pores per $dm^2$ and FIG. 4*a*), *b*), *c*) digital photographs of foil samples according to the invention and not according to the invention.

FIG. 1*a* first shows a SEM image of an aluminium alloy foil in the material state O with a thickness of 6 μm, which has a rolling pore with a diameter of approximately 30 μm. The previously known DIN EN 546-4 covers corresponding pores in aluminium alloy foils, as pores with a size of 20 μm upwards to 200 μm must be taken into account in accordance with this standard.

Figure 1B:
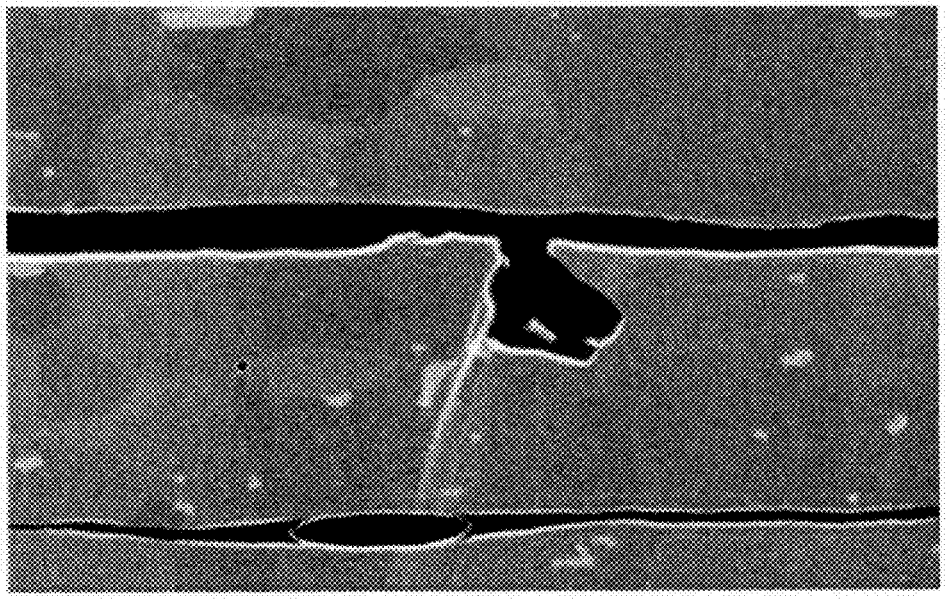

FIG. 1*b*, on the other hand, shows a SEM image of a section of a foil package charged with micropores, which has been prepared using Cross Section Polisher (CSP). The middle foil shows an indentation of approx. 1 μm and a micropore channel. It is assumed that micropores are three-dimensional structures which create a connection from one side of the foil to the other side of the foil that is not always straight.

It is easily conceivable that a high number of micropores with a size of significantly less than 20 μm, for example 1 to 5 μm, can also lead to the barrier effect of the aluminium alloy foil being negatively affected. For this reason, aluminium alloy foils, which have a low pore count per $dm^2$ in accordance with DIN EN 546-6, do not necessarily also have a very good barrier effect. This applies to all aluminium alloy types mentioned here, i.e. to alloys of type AA1xxx or AA8xxx.

The aluminium alloy foils according to the invention from the aforementioned aluminium alloy types AA8xxx and AA1xxx with a thickness of maximum 12 inn, maximum 9 μm or less than 8 μm, on the other hand, have a maximum number of pores with a pore size of 1 μm to 200 μm of maximum 12 per $dm^2$, maximum 8 or maximum 6 per $dm^2$ in the material state H2x or O. Thus, pores with a size of 1 μm to 20 μm, which are not taken into account in accordance with DIN EN 546-6, are also taken into account. By the aluminium alloy foils according to the invention having a particularly low maximum number of pores with a pore size of 1 μm to 200 μm and thus also of the smallest pores starting with 1 μm pore size, improved barrier properties of the aluminium alloy foil can be provided.

Figure 2:
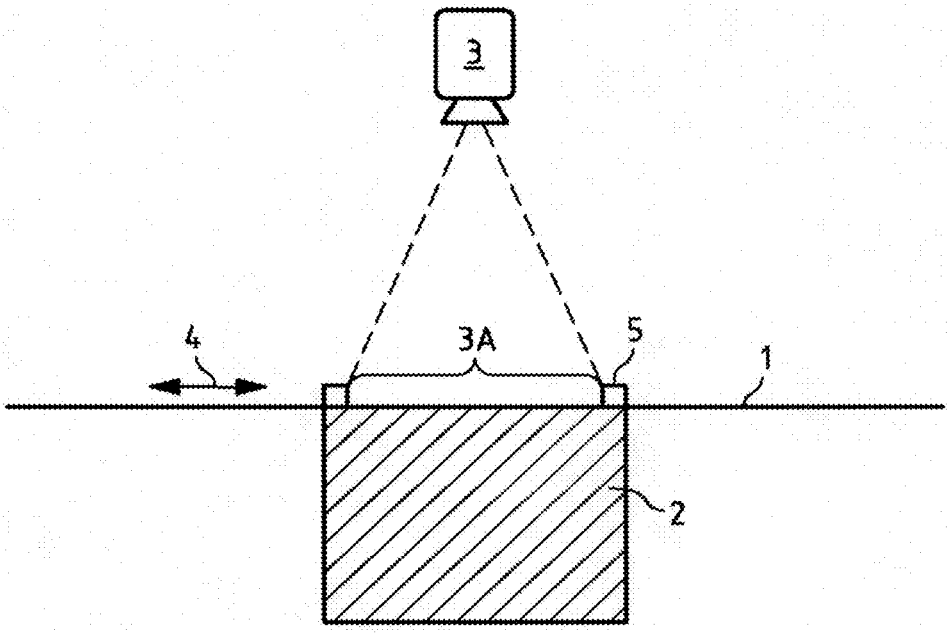
Figure 3:
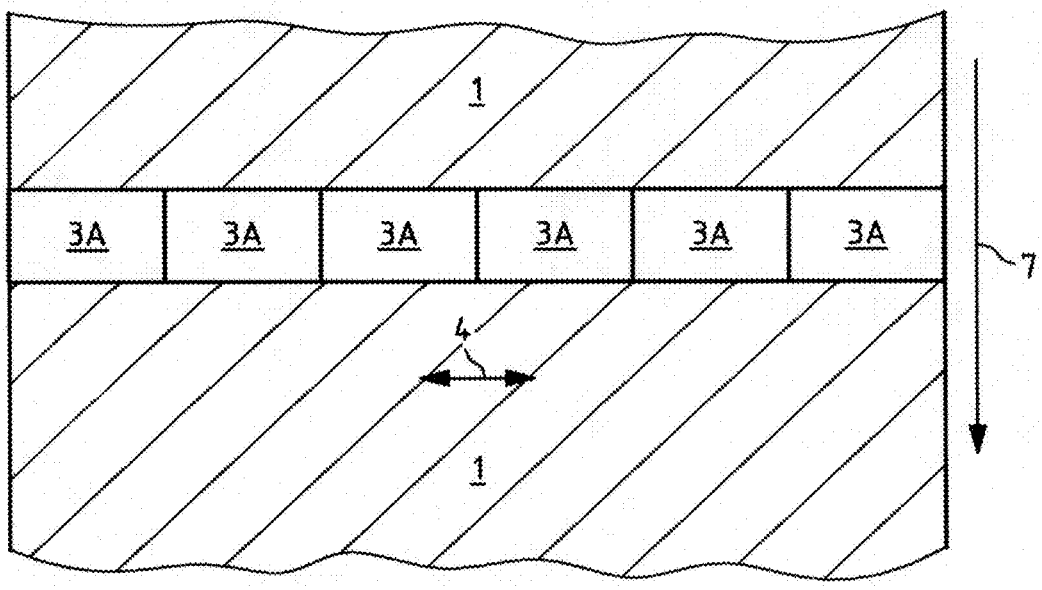

FIG. 2 now shows a schematic sectional view of a device for measuring the maximum number of pores per $dm^2$ over the entire foil width. FIG. 2 shows the aluminium alloy foil 1, a light source 2, for example an overhead projector and a photo camera 3, which is to photograph the measuring surface 3A for evaluation. The device must be positioned in a darkened room so that no scattered light affects the measurement. The remaining luminance in the darkened room is preferably less than 0.25 lux. The aluminium alloy foil 1 is fixed in the measuring range by a frame 5, which completely surrounds the measuring surface, such that the aluminium alloy foil 1 is positioned as flat as possible in the measuring surface 3A.

The light source 2 illuminates the aluminium alloy foil 1 through a transparent glass plate, which is not shown in FIG. 2. However, it is indicated by the expansion of the light source 2 that the illumination of the aluminium alloy foil 1 from below should be as homogeneous as possible. The distance of camera 3 must be selected depending on the size of the measuring area to be captured and the objective used. An objective with the smallest possible focal length should be selected such that the minimum distance can be selected in order to cover the measuring area with the best possible resolution.

The light source 2 is completely darkened with the aluminium alloy foil and the frame 5 such that only light which has penetrated the aluminium alloy foil 1 through pores within the measuring surface 3A can reach the camera. The aluminium alloy foil 1 is divided along the entire width 4 into preferably at least three or at least five measuring surfaces and thus the entire foil width is captured with the measurement. Since after foil rolling the aluminium alloy foils are often assembled to certain widths into so-called rolls and then annealed, the width 4 of the aluminium alloy foil 1 refers to the width of the foil roll or, without assembling, the entire width of the foil coil. The division into different measuring surfaces 3A, preferably at least five measuring surfaces 3A along the entire width of the aluminium alloy foil, also enables the detection of locally occurring populations of pores with sizes from 1 μm to 20 μm. These pores are not taken into account in the known porosity measurement according to DIN EN 546-4.

Figure 4A:
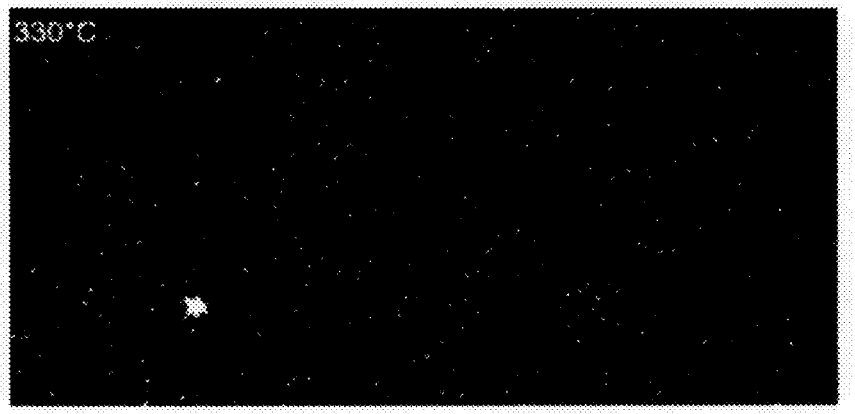
Figure 4B:
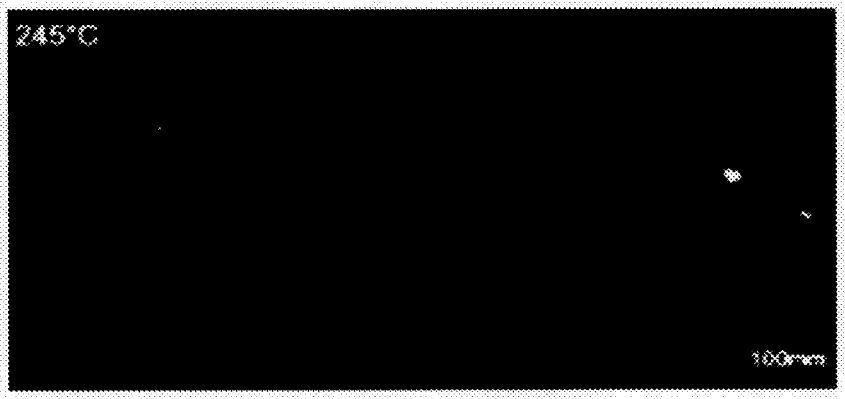
Figure 4C:
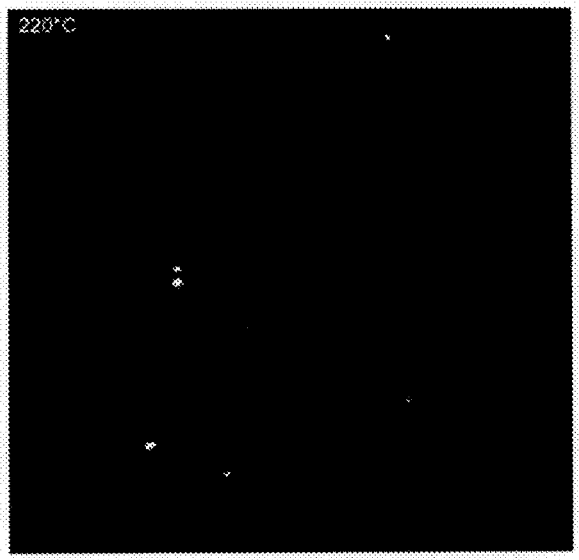

The following test setup was used for the foils measured in the following: The light source was an overhead projector from the company Andreas+Kern with an optical halogen lamp 36 V and 400 W with a luminous flux of up to 6000 lumens. The foil to be examined was placed on the projector and fixed via a metal frame of a defined size so that the foil laid flat on the projector and was sealed on the side. The camera used was a Sony Alpha 6000 with 6000×4000 pixels with an objective of the type Minolta MD Rokkor 50 mm f1.4. An aperture with a value of 2 with an ISO value of 800 at an exposure time of 30 seconds was used for the recordings. The distance from the camera sensor to the foil was 700 mm. The software Image Analyzer was used for image analysis. As FIG. 4 shows, the measuring surfaces 3A were arranged next to one another without gaps across the width 4 perpendicular to the longitudinal direction 7 of the aluminium alloy foil 1, so that the entire width of the aluminium alloy foil 1 is measured. The size of the measuring surface was 183 mm×276 mm and thus 5.0508 $dm^2$. From the measuring surface with the highest number of pores, the number of pores with a size of 1 μm to 200 μm was then determined by software and normalised to 1 $dm^2$ by dividing the measured number of pores in the worst measuring surface by the total area of the measuring surface in $dm^2$. The result was rounded to a whole number. With this measuring method, in particular the locally occurring smallest pores with a size of less than 20 μm, in particular 5 μm to 1 μm, can be recorded and counted.

As exemplary embodiment A, an aluminium alloy with an alloy composition according to Table 1 was cast into a rolling ingot. The aluminium alloy melt was thereby treated with flushing gases before and/or during the casting of the rolling ingot and filtered via degassers and a deep bed filter. As already mentioned, this filtration serves to prevent non-metallic impurities from the melt in the subsequent rolling ingot. The rolling ingot was then subjected to homogenisation, which was carried out in the temperature range of 420-600° C. for at least 5 hours for the present aluminium alloy, in order to bring as many casting phases as possible back into solution.

The rolling ingot was then hot rolled during hot rolling to a hot rolling final thickness of 2 mm to 4 mm and wound into a hot strip at a hot strip final temperature between 300° C. and 350° C. The hot strip was cold rolled in several cold rolling passes to an intermediate thickness of for example 0.60 mm to a maximum of 0.80 mm. Recrystallisation annealing was then carried out at a furnace air temperature of 450° C. to 550° C. for at least 5 hours. The aluminium strip thus recrystallised was subjected to further cold rolling steps to a second intermediate thickness between 11 μm and 20 μm and doubled for foil rolling. After doubling, intermediate annealing was carried out for half an hour at a furnace air temperature of 240° C. to 320° C. The foil rolling of the doubled strip was then carried out.

After separating the foil layers, optional assembling of the coil into rolls was carried out. The aluminium alloy foil had a final thickness of maximum 12 maximum 9 or less than 8 In the exemplary embodiment, a thickness of the aluminium alloy foil of 6.3 μm was achieved. After optional assembling, i.e. after cutting the foil to roll width and rolling up the rolls, final annealing of the rolls was carried out at 200° C. to 245° C. furnace air temperature for at least 150 hours with a cooling phase of at least 3 hours at 100° C. furnace air temperature. Unlike the exemplary embodiment A according to the invention, the comparative example B was annealed at a temperature of 330° C. for 50 hours and then cooled to room temperature.

In Table 2, the mechanical parameters of the aluminium alloy foil in accordance with DIN EN 546-2 of the two variants A and B are initially shown. It has been shown that surprisingly, the aluminium alloy A according to the invention, while having higher yield strength values $R_{p0.2}$ and tensile strength values $R_m$, still had similarly high elongation at break values $A_{100mm}$ measured diagonally to the rolling direction as the variant B annealed at high temperature. Comparison variant B, on the other hand, showed significantly lower yield strength values $R_{p0.2}$ and lower tensile strength values $R_m$.

The measurement of the oxide layer thickness distribution over the width of the aluminium alloy foil also showed that the variant A according to the invention has a more homogeneous distribution of the oxide layer thickness over the roll width than the variant B not according to the invention.

Manufacturing variants A and B were now examined regarding the maximum number of pores per $dm^2$ according to the present invention. At the same time, further aluminium alloy foils were manufactured from alloy 1 and final annealed using different processes. The measurements with the device described in FIG. 2 showed that furnace air temperatures up to 245° C. for 150 hours with a cooling phase at 100° C. furnace air temperature for 7 hours did not significantly influence the maximum number of pores per $dm^2$. As a maximum number of pores, 10 per $dm^2$ could be measured.

From a temperature of 260° C. for 100 hours or 280° C. for 100 hours, and in particular at 330° C. furnace air temperature for 50 hours without cooling phase, the values for the maximum number of pores with a size of 1 μm to 200 μm increased significantly. This is also illustrated by the photo shown in FIG. 4*a*) of an aluminium alloy foil not according to the invention which has been annealed according to variant B. Compared to the variants annealed according to the invention of FIGS. 4*b*) and 4*c*), very many, very small pores, which have a size of less than 20 inn, can be seen. The aluminium alloy foils in FIG. 4*b*) and c) were annealed at 245° C., or 220° C. respectively, furnace air temperature for 150 h with a cooling phase at 100° C. furnace air temperature for 7 h. As shown in FIGS. 4*b*) and 4*c*), the aluminium alloy foils according to the invention showed no populations of micropores and thus a significantly improved barrier property.

TABLE 1

Alloy composition in % by weight, remainder Al,

| Alloy | | Si | Fe | Cu | Mn | Mg | Cr | Zn | Ti | Ni |
|---|---|---|---|---|---|---|---|---|---|---|
| 1 | Inv. | 0.074 | 0.88 | 0.002 | 0.019 | 0.002 | 0.0007 | 0.005 | 0.005 | 0.004 |

TABLE 2

Mechanical parameters in accordance with DIN EN 546-2, state O

| | Final annealing | Rp0.2 [MPa] | | | Rm [MPa] | | | $A_{100\ mm}$ [%] |
|---|---|---|---|---|---|---|---|---|
| Var. | [h] @ [° C.] | l | q | d | L | Q | d | D |
| A | 150 @ 220 + 7 @ 100 | 61 | 60 | 59 | 84 | 82 | 80 | 6.7 |
| B | 50 @ 330 | 43 | 42 | 41 | 74 | 69 | 70 | 7.4 |

TABLE 3

Oxide layer thickness in [nm], state O

| | Oxide layer thickness gloss side [nm] | | Increase Edge vs. | | Oxide layer thickness matt side [nm] | | Increase Edge vs. | |
|---|---|---|---|---|---|---|---|---|
| Var. | Edge | Middle | Edge | Middle | Edge | Middle | Edge | Middle |
| A | 4.0 | 3.6 | 4.0 | 11% | 3.2 | 2.7 | 3.2 | 18.5% |
| B | 5.5 | 2.9 | 5.5 | 89% | 4.5 | 2.3 | 4.6 | 97.8% |

TABLE 4

Maximum number of pores

| Var. | | Final annealing [h] @ [° C.] | Maximum number of pores per $dm^2$ [pores/$dm^2$] |
|---|---|---|---|
| A | Inv. | 150 @ 220 + 7 @ 100 | 6 |
| B | Comp. | 50 @ 330 | 673 |
| C | Inv. | 150 @245 + 7@ 100 | 10 |
| E | Comp. | 100 @ 260 | 31 |
| F | Comp. | 100 @ 280 | 380 |

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An aluminium alloy foil with a thickness of maximum 12 μm, maximum 9 μm or less than 8 μm, wherein the aluminium alloy foil has an AA1xxx or AA8xxx aluminium alloy in the material state H2x or O, wherein the aluminium alloy foil has a maximum number of pores with a pore size of 1 μm to 200 μm of maximum 12 per $dm^2$, maximum 8 per $dm^2$ or maximum 6 per $dm^2$;

wherein the aluminium alloy foil has an aluminium alloy with the following alloy constituents in % by weight:
0.05%≤Si≤0.30%,
0.7%≤Fe≤1.3%,
Cu≤0.05%,
0.01%≤Mn≤0.05%,
Mg≤0.05%,
Cr≤0.05%,
Zn≤0.10%,
Ti≤0.025%, the remainder Al and unavoidable impurities individually at most 0.05%, in total at most 0.15%.

2. The aluminium alloy foil according to claim 1, wherein the aluminium alloy foil has an oxide layer thickness of 3 to 6 nm measured along the entire width of the aluminium alloy foil, wherein the oxide layer thickness of the aluminium alloy foil at the edge region of the aluminium alloy foil is at most 30% greater than in the middle of the aluminium alloy foil.

3. The aluminium alloy foil according to claim 1, wherein the oxide layer thickness is maximally 5 nm on both the matt and gloss side of the aluminium alloy foil.

4. The aluminium alloy foil according to claim 1, wherein the aluminium alloy of the aluminium alloy foil has at least one of the further restrictions of the alloy constituents in % by weight:
0.05%≤Si≤0.30%,
0.8≤Fe≤1.15%,
Cu≤0.05%,
0.015%≤Mn≤0.025%, preferably 0.018%≤Mn≤0.025%,
Mg≤0.01%, preferably Mg≤0.005%, particularly preferably Mg≤0.0035%,
Cr≤0.02%,
Zn≤0.07% and/or
0.005%≤Ti≤0.025%.

5. The aluminium alloy foil according to claim 1, wherein the aluminium alloy foil in the material state O has a yield strength Rp0.2 in accordance with DIN EN 546-2 of at least 55 MPa, preferably at least 58 MPa, measured transversely, longitudinally or diagonally to the rolling direction.

6. The aluminium alloy foil according to claim 3, wherein the aluminium alloy foil has a tensile strength Rm in accordance with DIN EN 546-2 of at least 80 MPa in the material state H2x or O, measured transversely, longitudinally and/or diagonally to the rolling direction.

7. The aluminium alloy foil according to claim 3, wherein the elongation at break $A_{100mm}$ in accordance with DIN EN 546-2 of the aluminium alloy foil is at least 6.2%, preferably at least 6.5%, measured diagonally to the rolling direction.

8. The aluminium alloy foil according to claim 1, wherein the aluminium alloy foil is final-annealed for at least 150 h at 200 to 245° C. furnace air temperature with a final coaling phase for at least 3 h at 100° C.

9. A method for manufacturing an aluminium alloy foil according to claim 1, wherein the method comprises the following steps:

manufacturing an aluminium alloy strip for cold rolling by casting a rolling ingot from an aluminium alloy of an AA1xxx or AA8xxx aluminium alloy, wherein the aluminium alloy melt is filtered before and/or during the casting of the rolling ingot, homogenising the cast rolling ingot and hot rolling of the rolling ingot into a hot strip or continuous casting of a casting strip from a melt of a filtered aluminium alloy of type AA8xxx or AA1xxx with a subsequent, optional hot rolling of the casting strip, cold rolling of the aluminium alloy strip to a first intermediate thickness, recrystallisation annealing of the cold-rolled aluminium alloy strip at this intermediate thickness, cold rolling of the aluminium alloy strip to a second intermediate thickness, doubling the aluminium alloy strip and carrying out an intermediate annealing, foil rolling of the doubled aluminium alloy strip to the final thickness of the doubled foil, separating and winding up the layers at a final thickness of the individual layers of maximum 12, maximum 9 μm or less than 8 μm, wherein optionally the aluminium alloy foil is assembled in a plurality of rolls and carrying out a final annealing of the coil or the assembled rolls for at least 150 h at 200 to 245° C. furnace air temperature with a final cooling phase for at least 3 h, preferably at least 7 h, at 100° C. furnace air temperature.

10. The method according to claim 9, wherein the aluminium alloy has the following alloy constituents in % by weight:
0.05%≤Si≤0.30%,
0.7≤Fe≤1.3%,
Cu≤0.05%,
Mn≤0.05%,
Mg≤0.05%,
Cr≤0.05%,
Zn: ≤0.10%,
Ti: ≤0.025%, the remainder Al and unavoidable impurities individually 0.05% by weight, in total at most 0.15% by weight, and the recrystallisation annealing of the cold-rolled strip is carried out at furnace air temperature of 450° C. to 550° C. for at least 5 h and the intermediate annealing after doubling the strip is carried out at a furnace air temperature of 240° C. to 320° C. for 0.5 h.

11. The method according to claim 10, wherein the aluminium alloy foil has at least one of the following restrictions of the alloy constituents in % by weight:
0.05%≤Si≤0.30%,
0.8%≤Fe≤1.15%,
Cu≤0.05%,
0.01%≤Mn≤0.04%, preferably 0.015%≤Mn≤0.035%, particularly preferably
0.018%≤Mn≤0.025%, Mg≤0.01%, preferably Mg≤0.005%, particularly preferably Mg≤0.0035%, Cr≤0.02%, Zn≤0.07% and/or 0.005%≤Ti≤0.025%.

12. The method according to claim 9, wherein the homogenising of the rolling ingot is carried out at 420 to 600° C. for at least 7 h.

13. The method according to any one of claim 9, wherein the rolling ingot is hot rolled to a hot rolling final thickness of 2 mm to 4 mm during hot rolling and the hot rolling final temperature is between 300° C. and 350° C.

14. The method according to claim 9, wherein the final annealing is carried out for at least 150 h at 200° C. to 225° C.

15. A method, comprising:

utilizing the aluminium alloy foil according to claim 1 in a multi-layer composite material, in particular packages with barrier requirements for the aluminium foil.

* * * * *